US006090340A

United States Patent [19]

Boonacker et al.

[11] Patent Number: 6,090,340

[45] Date of Patent: Jul. 18, 2000

[54] RUNNER FOR A HOT MELT, RUNNER SYSTEM AND METHOD FOR CONVEYING A HOT MELT

[75] Inventors: Rudolf Boonacker, Haarlem; Jacobus Van Laar, Driehuis; Coert Johannes Nooij, IJmuiden; Gerardus Jozef Tijhuis, Heemskerk, all of Netherlands

[73] Assignee: Hoogovens Technical Services Europe BV, Ijmuiden, Netherlands

[21] Appl. No.: 09/242,926

[22] PCT Filed: Aug. 27, 1997

[86] PCT No.: PCT/NL97/00486

§ 371 Date: Apr. 26, 1999

§ 102(e) Date: Apr. 26, 1999

[87] PCT Pub. No.: WO98/08982

PCT Pub. Date: Mar. 5, 1998

[30] Foreign Application Priority Data

Aug. 27, 1996 [NL] Netherlands ..... 1003885

[51] Int. Cl.[7] ..... C21B 7/10

[52] U.S. Cl. ..... 266/46; 266/191; 266/196

[58] Field of Search ..... 266/191, 196, 266/46, 45

[56] References Cited

U.S. PATENT DOCUMENTS

| | | | |
|---|---|---|---|
| 3,316,685 | 5/1967 | Hensel . | |
| 3,587,198 | 6/1971 | Hensel . | |
| 4,508,323 | 4/1985 | Fleming | 266/196 |
| 5,129,631 | 7/1992 | Van Laar | 266/196 |

FOREIGN PATENT DOCUMENTS

| | | |
|---|---|---|
| 060239 | 9/1982 | European Pat. Off. . |
| 065034 | 11/1982 | European Pat. Off. . |
| 090761 | 10/1983 | European Pat. Off. . |
| 2393637 | 1/1979 | France . |
| 4173911 | 6/1992 | Japan . |
| 6603983 | 9/1966 | Netherlands . |
| 9313375 | 7/1993 | WIPO . |

*Primary Examiner*—Scott Kastler

*Attorney, Agent, or Firm*—Stevens, Davis, Miller & Mosher, L.L.P.

[57] ABSTRACT

Runner for conveying a hot melt, for example molten pig iron and slag, comprising a wear lining in which the melt flows during normal operation, a safety lining which surrounds the wear lining and a metal encasing which surrounds the safety lining, wherein the safety lining is made essentially of a refractory concrete, and the metal encasing and the safety lining are joined to one another by anchoring means, and wherein a means for keeping the encasing at a higher temperature where it would otherwise have a relatively cool spot is situated locally on the outwardly facing side of the encasing.

25 Claims, 1 Drawing Sheet

RUNNER FOR A HOT MELT, RUNNER SYSTEM AND METHOD FOR CONVEYING A HOT MELT

TECHNICAL FIELD

Figure 1:
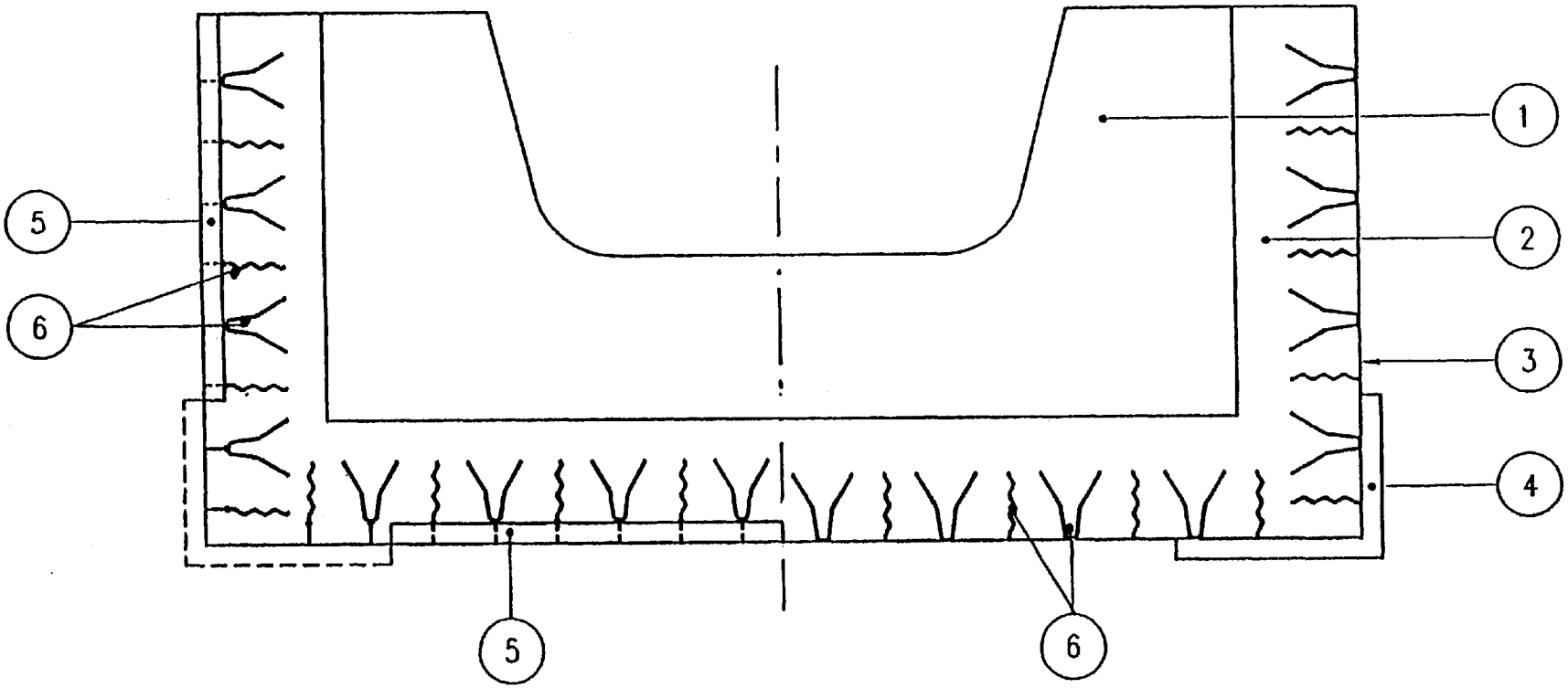

The invention relates to a runner for conveying a hot melt, for example molten pig iron and slag, comprising a wear lining in which the melt flows during normal operation, a safety lining which surrounds the wear lining and a metal encasing which surrounds the safety lining, and also to a runner system comprising such a runner, and also to a method for conveying a hot melt.

DESCRIPTION OF THE PRIOR ART

A runner of said type is known in the steel world and is used therein in tapping pig iron from a blast furnace.

A problem in operating such a runner is that, as a result of expansion and shrinkage of the various constituent refractory components of the runner, they crack at the top, particularly when situated at the side edges, and threaten to disintegrate. In addition, the side edges situated opposite one another have the tendency to start to give way. A known method of combatting this problem is therefore to stiffen the metal encasing by fitting external reinforcing ribs and the like thereto, which has the disadvantage, however, that base and side edges of the encasing start to fold locally and bulge out. Attempts are made to combat the problems caused by this by possibly locally cooling the encasing on the outside with the aid of, for example, forced air flow or water cooling.

DESCRIPTION OF THE INVENTION

According to the invention, the problems are solved or at least reduced in another way.

In the case of the runner according to the invention, the safety lining is made essentially of a refractory concrete and the metal encasing and the safety lining are joined to one another by anchoring means, and a means for keeping the encasing at a higher temperature where it would otherwise have a relatively cool spot is situated locally on the outwardly facing side of the encasing.

As a result, a runner has been constructed which is composed more or less of one piece, the metal encasing being, as a result, under a tensile stress and the refractory material inside the encasing being under pressure during operation. As a result of coupling to anchoring means, there is a well-defined heat flow profile both when viewed in cross section and over the length of the runner.

According to the invention, it is specifically decided not to cool the metal encasing on the outside, but on the contrary, it is preferable, according to the invention, that a relatively cool spot is heated or brought by suitable insulation to temperature and kept there.

Under some circumstances it may be advantageous, optionally in combination with keeping relatively cool spots at temperature as discussed above, for a means for keeping the encasing at a lower temperature where it would otherwise have a relatively hot spot to be situated locally near the inwardly facing side of the casing.

For the purpose of longer service life, the safety lining made essentially of refractory concrete comprises a reinforcing material, preferably in the form of steel needles.

The invention is furthermore embodied in a runner system comprising a runner according to one of the preceding claims and furthermore a support for the runner, the runner and support being movable with respect to one another. This achieves the result that the runner support exerts no undesirable forces on the runner.

The invention is also embodied in a method for conveying a hot melt, for example molten pig iron, wherein the hot melt is fed via a runner or via a runner system according to the invention.

DISCUSSION OF THE FIGURE

The invention will now be explained in greater detail by reference to the drawing, in which:

FIG. 1 shows a cross section through the runner.

The right-hand half of the diagram in FIG. 1 shows a runner according to the invention in one embodiment and the left-hand half shows another embodiment.

In FIG. 1, 1 is the wear lining through which, for example, liquid pig iron, optionally together with slag, flows during operation. The wear lining 1 is surrounded by a safety lining 2. The refractory portion of the runner is surrounded in turn by a metal encasing 3. The safety lining 2 and the metal encasing 3 are coupled to one another with the aid of anchors 6 which are, for example, welded to the encasing 3 and are embedded in the safety lining 2.

According to the invention, means 4 for keeping the encasing 3 sufficiently hot, for example insulation strips 4, are situated, in a runner of the type shown, at the "cooler corners". It is also possible, optionally in combination therewith, as shown in the left-hand half of the FIGURE, to provide insulation material 5 on the inside at a "hot spot" in the encasing 3 in order to keep the encasing 3 relatively cool locally at that point.

It is possible for one or more intermediate linings also to be situated between wear lining 1 and safety lining 2. By rigidly joining, according to the invention, the metal encasing 3 to the safety lining 2 and not cooling or cooling it less on the outside, but on the contrary, allowing it to acquire a higher temperature, a durable runner is obtained in a relatively simple way.

What is claimed is:

1. A runner for conveying a hot melt, comprising:

a wear lining (1) in which the melt flows during normal operation, a safety lining (2) which surrounds the wear lining (1), and a metal encasing (3) which surrounds the safety lining (2), the encasing (3) having an outwardly facing side, wherein the safety lining (2) comprises refractory concrete, and the metal encasing (3) and the safety lining (2) are joined to one another by anchoring means (6), and a means (4) for keeping the metal encasing (3) at a higher temperature where it would otherwise have a relatively cool spot which is situated locally on an outwardly facing side of the encasing (3).

2. A runner for conveying a hot melt, comprising:

a wear lining (1) in which the melt flows during normal operation, a safety lining (2) which surrounds the wear lining (1) and a metal encasing (3) which surrounds the safety lining (2), the encasing (3) having an inwardly facing side, wherein the safety lining (2) comprises a refractory concrete, and the metal encasing (3) and the safety lining (2) are joined to one another by anchoring means (6), and a means (5) for keeping the metal encasing at a lower temperature where it would otherwise have a relatively hot spot which is situated locally near the inwardly facing side of the encasing.

3. A runner according to claim 1, wherein the means for keeping the encasing at a higher temperature comprises a layer of insulating material.

4. A runner according to claim 1, wherein the safety lining (2) comprises reinforcing material.

5. A runner according to claim 4, wherein the rein forcing material comprises steel needles.

6. A runner system comprising a runner according to claim 1 and, furthermore, a support for the runner, wherein the runner and the support are movable with respect to one another.

7. A method for using a runner of claim 1, comprising conveying a hot metal melt, wherein the hot melt is fed via the runner.

8. A runner according to claim 2, wherein the means for keeping the metal encasing hot spot at a lower temperature comprises a layer of insulating material.

9. A runner according to claim 2, wherein the safety lining (2) comprises reinforcing material.

10. A runner according to claim 2, wherein the reinforcing material comprises steel needles.

11. A runner system comprising a runner according to claim 2 and, furthermore, a support for the runner, wherein the runner and the support are movable with respect to one another.

12. A method for using a runner of claim 2, comprising conveying a hot metal melt, wherein the hot melt is fed via the runner.

13. A method for using a runner system of claim 6, comprising conveying a hot metal melt, wherein the hot melt is fed via the runner system.

14. A method for using a runner system of claim 11, comprising conveying a metal melt, wherein the hot melt is fed via the runner system.

15. A runner for conveying a hot melt comprising:

a wear lining (1), a safety lining (2) which surrounds the wear lining (1) and a metal encasing (3) which surrounds the safety lining (2), wherein the safety lining (2) comprises refractory concrete, and the metal encasing (3) and the safety lining (2) are joined to one another by anchoring means (6), said metal encasing (3) having an inwardly facing side and an outwardly facing side, said encasing (3) having first portions which are heated by the hot melt less than other portions of the casing (3), and temperature maintenance means (4) selected from the group consisting of means for heating these first portions of said metal encasing (3) and means for insulating these first portions of said metal encasing (3), said temperature maintenance means being situated locally to said first portions on an outwardly facing side of the metal encasing (3).

16. The runner of claim 1, wherein the metal encasing comprises a bottom wall and attached side walls which form opposed longitudinal corners, and the means for heating cool spots comprises respective layers of insulation at respective opposed longitudinal corners of the metal runner where the runner bottom wall meets the runner side walls.

17. The runner of claim 1, wherein the metal encasing comprises a bottom wall and attached side walls which form opposed longitudinal corners, and the means for heating cool spots consists of respective layers of insulation at respective opposed longitudinal corners of the metal runner where the runner bottom wall meets the runner side walls.

18. The runner of claim 2, wherein the means for cooling comprises a layer of insulation on the inwardly facing side of the encasing.

19. The runner of claim 2, wherein the means for cooling hot spots consists of a layer of insulation on the inwardly facing side of the encasing.

20. The runner of claim 15, wherein the metal encasing comprises a bottom wall and attached side walls which form opposed longitudinal corners the means for heating cool spots comprises respective layers of insulation at respective opposed longitudinal corners of the metal runner where the runner bottom wall meets the runner side walls.

21. The runner of claim 15, wherein the metal encasing comprises a bottom wall and attached side walls which form opposed longitudinal corners the means for heating cool spots consists of respective layers of insulation at respective opposed longitudinal corners of the metal runner where the runner bottom wall meets the runner side walls.

22. The runner of claim 1, wherein the hot melt comprises molten pig iron and slag.

23. The runner of claim 2, wherein the hot melt comprises molten pig iron and slag.

24. The method of claim 7, wherein the hot melt comprises molten pig iron and slag.

25. The method of claim 11, wherein the hot melt comprises molten pig iron and slag.

* * * * *